United States Patent [19]

Tenedini et al.

[11] Patent Number: 4,547,977

[45] Date of Patent: Oct. 22, 1985

[54] FREEZE DRYER WITH IMPROVED TEMPERATURE CONTROL

[75] Inventors: Kenneth J. Tenedini, New Paltz; David T. Sutherland, Kingston, both of N.Y.

[73] Assignee: The VirTis Company, Inc., Gardiner, N.Y.

[21] Appl. No.: 612,328

[22] Filed: May 21, 1984

[51] Int. Cl.[4] ..... F26B 21/06

[52] U.S. Cl. ..... 34/46; 34/92; 165/65; 236/78 D; 236/12.12

[58] Field of Search ..... 34/5, 92, 46; 236/12.12, 78 C, 78 D; 165/35, 65

[56] References Cited

U.S. PATENT DOCUMENTS 3,625,279 12/1971 Mayo ..... 165/65 X
3,909,957 10/1975 Passey ..... 34/5

FOREIGN PATENT DOCUMENTS 8004907 8/1980 Netherlands ..... 236/78 C

*Primary Examiner*—William E. Wayner
*Attorney, Agent, or Firm*—Leydig, Voit & Mayer, Ltd.

[57] ABSTRACT

The circulation of heat transfer fluid through the low temperature heat exchanger in the temperature control system of a freeze dryer is selectively increased when the temperature of heat being applied to the product shelf assembly in the freeze dryer exceeds the desired temperature. Preferably, a servo-controlled mixing valve selectively bypasses the low temperature heat exchanger so that the rate of cooling is very precisely adjusted without requiring the heat exchanger refrigeration unit to be cycled on and off. Since the refrigeration unit operates continuously, the reliability and operating lifetime of the refrigeration unit is increased. Moreover, the heat exchanger temperature is maintained at a minimum value. Preferably, the servo-control for the mixing valve includes a digitally controlled stepping motor and the adjustment of the mixing valve is sensed by a linear voltage displacement transducer. To prevent short cycling and oscillation, a dead band is introduced in the servo-control loop. To reduce temperature overshoot yet achieve a fast response time, a rate function is included in the temperature control loop as well as nonlinear characterization of the temperature control loop gain to provide a quick response to large control steps. Preferably the same rate function, representative of the thermal inertia or heat capacity of the dryer system, is included in the control loop for the heater as well as the control loop for the low temperature heat exchanger.

4 Claims, 9 Drawing Figures

FREEZE DRYER WITH IMPROVED TEMPERATURE CONTROL

TECHNICAL FIELD

The present invention relates generally to freeze dryers, and more particularly to temperature control systems for freeze dryers.

BACKGROUND OF THE INVENTION

Freeze drying is used for both laboratory and production processes to preserve biological material. Freeze drying involves the application of heat to a frozen substance containing moisture so that the moisture is removed by sublimation without any other appreciable change in the substance. The reader is no doubt familiar with freeze dried instant coffee, prepared by freezing and drying brewed coffee. In a similar fashion, freeze drying preserves microbial serum for storage and distribution. Whole biological specimens or tissue samples also retain their original physical appearance after freeze drying. The absence of water in freeze dried specimens allows safe storage and display at normal room temperature.

The key to the retention of the physical characteristics of the freeze dried material lies in the fact that neither the freezing nor the sublimation process disturbs the physical orientation of the solid components of the material. Since the solid components are locked in an ice matrix during drying, they do not react chemically or change physically.

For moisture to be efficiently removed by sublimation, however, an optimum temperature and vapor pressure difference must be established and maintained between the frozen material and its atmospheric environment during the sublimation process. In a freeze dryer this state of unbalance is established by placing the frozen material in a vacuum chamber connected to a pump for maintaining a relatively low atmospheric pressure in the chamber, a low temperature condenser for further reducing the water vapor pressure in the chamber, and a heating system for applying heat to the frozen product to replace the heat of sublimation and thereby maintain a relatively fast rate of sublimation. The rate of sublimation, however, is limited by the maximum amount of heat which can be applied to the frozen material without causing thawing or "melt back" to occur. Melt back may occur even though the chamber pressure is low since the material dries at a defined surface within the material called the ice interface. As the ice interface moves deeper into the material, the dry material outside of the ice interface impedes the release of sublimated vapor thereby raising the temperature and relative pressure of the frozen material.

To avoid melt back, the rate of heat energy applied to the frozen material must not exceed the rate at which heat is absorbed by the release of sublimated vapor. Another limitation on the rate of sublimation is the rate at which the low temperature condenser can efficiently remove sublimated vapor due to icing and frosting of the condenser surfaces, and the rate at which sublimated vapor nigrates to the condenser. The presence of an effective low temperature condenser greatly reduces and simplifies the vacuum pumping requirement.

In practice, the freeze dryer must provide an active condensing surface lower than −40° C., evacuation of the drying chamber to an absolute pressure of between 5 and 20 microns of Hg, and a controlled source of heat to the frozen material. The source of heat is controlled according to a time-temperature program responsive to a temperature sensor in the drying chamber, or preferably, by a sample probe in contact with the material being dried. For very sensitive materials, a system that can alternately apply both heat and refrigeration may be required. In order to dry a wide variety of products, the range of temperature control should be at least between −40° and 65°.

Further background information on general freeze drying applications is found in *Freeze Drying and Advance Food Technology,* edited by S. A. Goldbith, L. Reynold, W. W. Rothmayr, Academic Press 1975; *Advances in Freeze-drying,* edited by L. Rey, Hermann, 115 Boulevard Saint-Germain, Paris VI, 1966; *Freeze Drying of Foods,* C. Judson King, CRC Press 1971; and *Biological Application of Freezing and Drying,* edited by R. J. C. Harris, Academic Press, 1954.

One particular application when precise temperature control is especially important is the freeze drying of production lots of pharmaceutical, biological and chemical products. For this purpose vacuum drying chambers up to six feet in diameter are provided for holding tens of thousands of serum bottles in a single run. The freeze drying pcoess is programmed according to a cooling and heating sequence of predefined temperatures at predefined times throughout the run. The program is typically stored in the memory of a microprocessor which also reads a product shelf temperature sensor, product temperature sensors, product resistance sensors, and the chamber pressure. From the stored sequence a microprocessor control program determines the desired temperature throughout the cycle and checks that the product temperature for solidification is obtained after cooling and that proper vacuum is obtained at the beginning of the drying sequence. The control program further checks the product temperature and resistance during drying and, if necessary, prolongs the drying sequence.

The microprocessor control passes the desired parameter to a shelf temperature control system which maintains the product shelf at the desired temperature. In the conventional production dryer, a refrigerator is activated to lower the temperature of a heat transfer fluid when the product shelf temperature exceeds the desired temperature, and the heater is energized to warm the heat transfer fluid when the product shelf temperature falls below the desired temperature. Circulation of the heat transfer fluid through the shelf assembly, heater, and a heat exchanger cooled by the refrigerator is provided by a centrifugal pump.

SUMMARY OF THE INVENTION

The primary object of the invention is to provide an improved temperature control system for a freeze dryer that more precisely regulates the temperature in the freeze dryer to match a desired temperature.

Another object of the invention is to reduce temperature overshoot during the operation of a freeze dryer in a production run.

Still another object of the invention is to prevent short cycling and oscillation in the temperature control of a large production freeze dryer.

And yet another object of the invention is to provide enhanced regulation of the cooling of the product shelf assembly in the vacuum chamber.

Moreover, another object of the invention is to increase the reliability and operating lifetime of the refrigeration system in a freeze dryer.

Briefly, in accordance with the present invention, means are provided for regulating the circulation in the freeze dryer through the low temperature heat exchanger when the desired temperature is less than the measured temperature. Preferably, a servo-controlled mixing valve selectively bypasses the low-temperature heat exchanger so that the rate of cooling is very precisely adjusted without requiring the heat exchanger refrigeration unit to be cycled on and off. Since the refrigeration unit operates continuously, the reliability and operating lifetime of the refrigeration unit is increased. To prevent short cycling and oscillation, a dead band is introduced in the servo control loop. To reduce temperature overshoot yet achieve a fast response time, a rate function is included in the temperature control loop as well as nonlinear characterization of the temperature control loop gain to provide a quick response to large control steps. Preferably the same rate function, representative of the thermal inertia or heat capacity of the dryer system, is included in the control loop for the heater as well as the control loop for the condenser.

BRIEF DESCRIPTION OF THE DRAWINGS

Other objects and advantages of the invention will become apparent upon reading the following detailed description and upon reference to the drawings in which.

Figure 1:
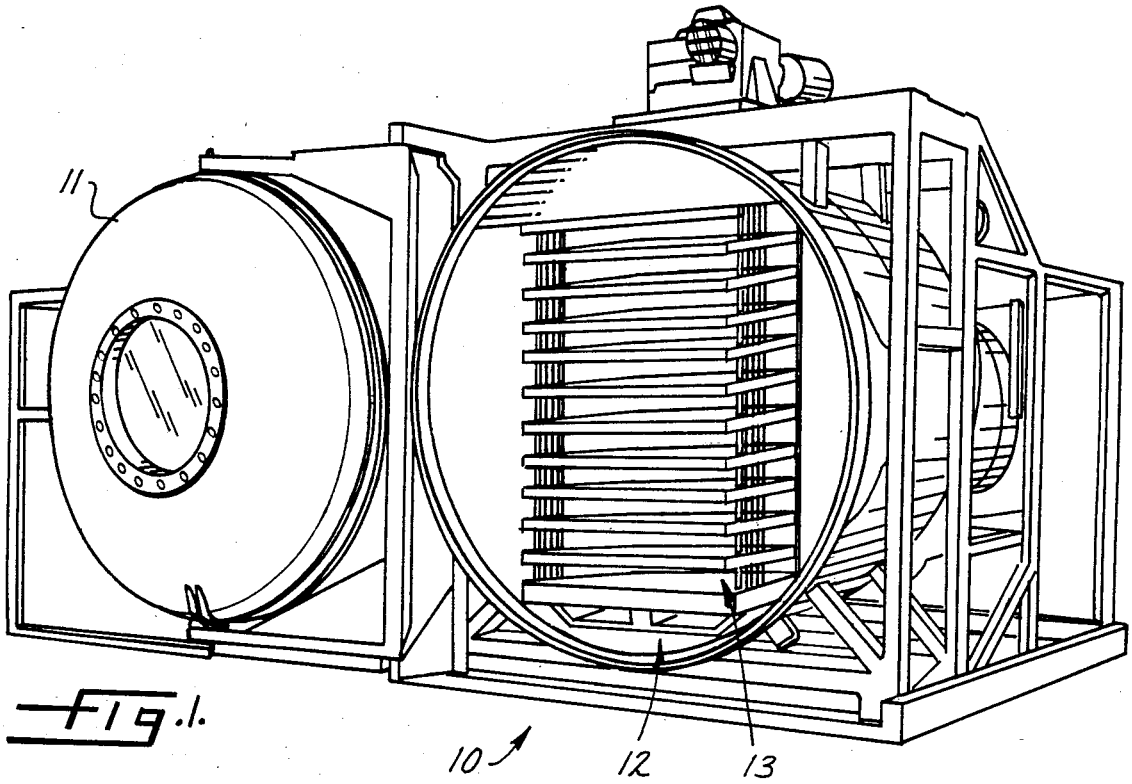
FIG. 1 is a pictorial drawing of a large capacity freeze dryer for which the present invention is particularly advantageous.

While the invention is susceptible to various modifications and alternative forms, a specific embodiment thereof has been shown by way of example in the drawings, and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

DESCRIPTION OF THE PREFERRED EMBODIMENT

Turning now to the drawings, there is shown in FIG. 1 a pictorial drawing of a high capacity freeze dryer or sublimator generally desigated 10 shown with an open door 11 exposing the vacuum chamber 12. The vacuum chamber 12 is approximately 6 feet in diameter and has a plurality of shelves generally designated 13 for holding up to 25,000 serum bottles at a single time. As shown, the freeze dryer 10 is a type 501-SRC-11-X (trademark) sublimator manufactured and sold by the VirTis Company, Gardiner, New York, N.Y. 12525.

Figure 2:
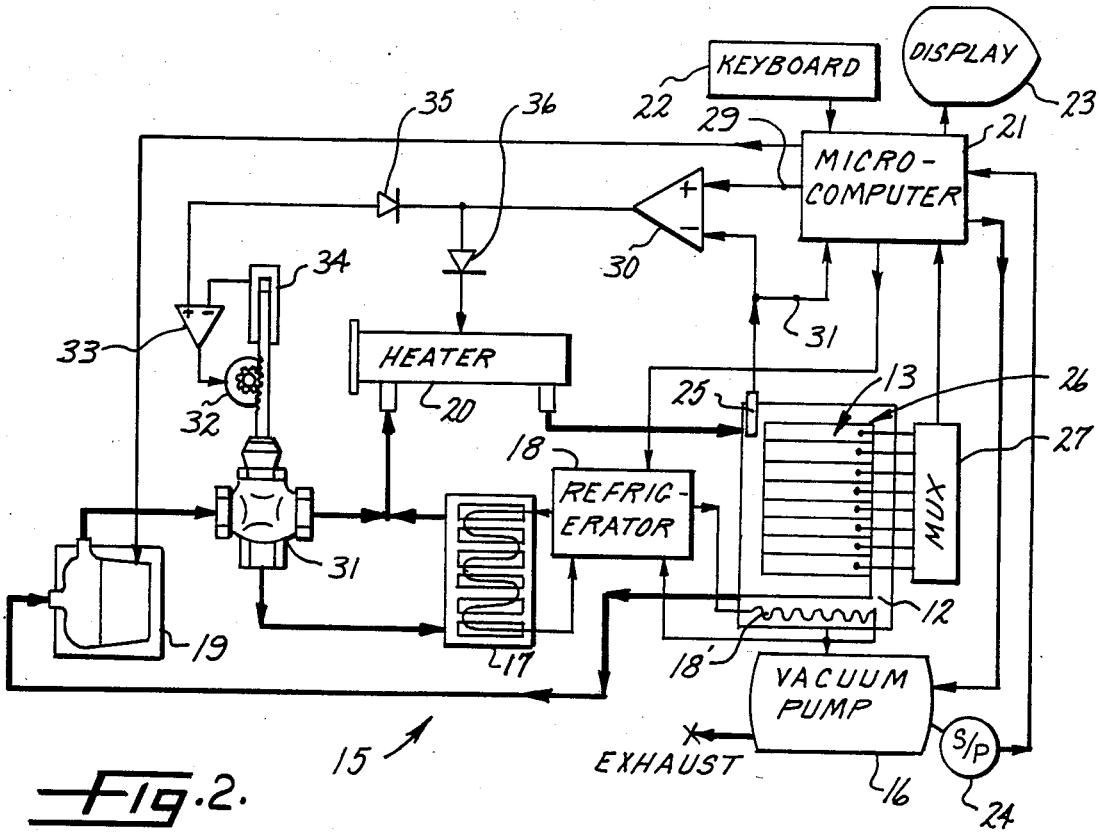
FIG. 2 is a schematic diagram of the freeze dryer of FIG. 1 incorporating the preferred embodiment of the present invention.

The present invention concerns an improved temperature control which is particularly advantageous for high capacity freeze dryers such as the sublimator 10 shown in FIG. 1. Shown in FIG. 2 is a schematic diagram generally designated 15 of the vacuum and control system for the sublimator generally designated 10 of FIG. 1, including the improved temperature control. In order to achieve a vacuum better than 50 microns, a vacuum pump 16 removes air from the vacuum chamber 12 and exhausts to the atmosphere. Even when a substantial vacuum is obtained, however, there is residual water vapor left in the vacuum system. A condenser 18' is cooled by a refrigerator 18 in order to condense the residual water vapor to the form of ice or frost.

In order to precisely control the temperature of the product on the proudct shelf assembly 13, a heat transfer fluid such as freon 11 is circulated through the product shelves. A low-temperature heat exchanger 17 cooled by the refrigerator 18 is provided to cool the heat transfer fluid. The heat transfer fluid is conveyed to the low temperature heat exchanger 17 by a circulation pump 19. Also, a heater 20 is provided to warm the heat transfer fluid returning to the product shelf assembly 13.

Depending on the type of product placed on the shelves 13 in the vacuum chamber 12, the temperature in the vacuum chamber 12 is controlled according to a predetermined function of time defining a sublimation or drying cycle. In the most elementary cycle, the product is cooled at approximately 1° C. per minute to −40° C. or lower to ensure that the product is thoroughly frozen. Then, the vacuum pump 16 pumps down the chamber 12 to 50 microns or lower. Finally, the product is heated at a rate of approximately 0.5° C. per minute.

In order to define the freeze drying cycle, a microcomputer 21 is provided with a stored program including at least the lowest temperature that is desired and the freezing and warming rates. Typically a keyboard 22 is provided so that the operator may enter or change the desired freezing temperature and the cooling and warming rates. To show the operator's selection, a display 23 is also provided.

Preferably, the microcomputer 21 is programmed to both monitor and control the freeze drying process. The microcomputer 21 reads a pressure sensor 24 to ensure that the desired level of vacuum is obtained. Also, the microcomputer 21 turns on the vacuum pump 16, the refrigerator 18, and the circulation pump 19 at the required times in the cycle. In order to check that the desired temperature are obtained in the vacuum chamber 12, a product shelf temperature sensor 25 senses the temperature of the heat transfer fluid being circulated to the shelf assembly 13. For very precise monitoring of the product temperature, individual sensors 26 are provided. Typically, a multiplexer 27 sequentially scans the individual sensors 26 and the microcomputer 21 is programmed to compute an average temperature based on the output of the multiplexer 27.

The microcomputer 21 includes a standard microprocessor such as a Z80 along with read only memory (ROM) and random access memory (RAM). The microcomputer 21 is programmed according to standard programming techniques to operate the vacuum pump 16, refrigerator 18, and circulation pump 19 during the required times throughout the freeze drying cycle. Preferably, the microcomputer 21 and related software comprises a "Command Performance II" dedicated microprocessor control system manufactured and sold as a staple item of commerce by the VirTis Company, Gardiner, New York, N.Y. 12525. By using this particular microprocessor control system, any combination of cooling and heating rates can be preprogrammed and the microcomputer will constantly supervise each product for complete solidification before initiating the drying cycle. The solidification is determined, for example, by the individual product shelf temperature sensors 26. For the purposes of the present invention, however, the microcomputer 21 is merely a means for providing a desired temperature of the heat to be applied to the product in the drying chamber 12 as a predetermined function of time defining the freeze drying cycle.

The microcomputer generates a corresponding desired temperature signal on an output line 29. A comparator generally designated 30, compares the desired temperature to the temperature of heat applied to the product in the drying chamber which is sensed, for example, by the product shelf sensor 25. The error signal from the comparator 30 is used to regulate the heating and cooling of the drying chamber 12. It should be noted, however, that for practicing the present invention, any temperature sensor in the vacuum system could be used to sense the temperature of the heat being applied to the product in the drying chamber 12. For the microcomputer system shown in FIG. 2, for example, it is typical for the desired temperature signal on the output line 29 to be slightly adjusted in response to the average temperature sensed by the individual product shelf sensors 26. For this purpose, the microcomputer 21 is provided with an input line 31 which receives a signal indicating the temperature sensed by the product shelf sensor 25. Thus, if the desired temperature 29 is adjusted by the difference between the average temperature indicated by the sensors 26 and the temperature indicated by the sensor 25, then the comparator 30 will become responsive to the average temperature indicated by the sensors 26.

For the large capacity sublimator generally designated 10, it is desirable to control the temperature of the heat being applied to the product in the drying chamber to a tolerance of better than 1° C. In the past, this has been attempted by turning the refrigerator 18 on and off in response to the error signal from the comparator 30. Rather precise control of the refrigertor 18, for example, has been obtained by a valve regulating the flow of refrigerant in the refrigerator. Such a method of cooling regulation, however, decreases the reliability and operating lifetime of the refrigerator. Moreover, the time for the system to respond to the turning on and off of the refrigerator 18 is not as fast as one would desire, and in some situations, the temperaure of the heat exchanger 17 might not be as low as it could be in order obtain the lowest possible fluid temperature in the heat exchanger.

In accordance with the primary aspect of the present invention, means are provided for regulating the circulation of the heat transfer fluid through the low temperature heat exchanger 17 in response to a cooling control signal. Means are provided for generating the cooling control signal when the desired temperature is less than the temperature of the heat applied to the product in the drying chamber, so that the circulation of the fluid through the refrigerated heat exchanger 17 is increased in response to an increasing difference between the sensed temperature and the desired temperature. Preferably, the means for regulating the circulation of the fluid through the refrigerated exchanger 17 is provided by a mixing valve 31 which selectively bypasses the circulation of the fluid through the heat exchanger 17. The mixing valve 31 is operated by a servomotor generally designated 32 which is activated in response to a comparator 33 comparing the valve adjustment sensed by a linear position sensor 34 to a desired position responsive to the cooling control signal. In the schematic diagram shown in FIG. 2, the means for generating the cooling control signal is indicated by the comparator 30 and a directional diode 35 excited by the error signal from the comparator. Similarly, a directional diode 36 is provided to indicate that the heater 20 is energized when the error signal from the comparator 30 is positive, while the cooling is increased when the error signal from the comparator 30 becomes substantially negative. As will be described below in conjunction with FIG. 6, the diodes 35 and 36 shown in FIG. 2 are simplified representations of nonlinear gain characterization functions. When the desired temperature exceeds the sensed temperature in the drying chamber 12, the heater 20 is energized in response to the difference. But when the sensed temperature in the drying chamber 12 exceeds the desired temperature, then the mixing valve 31 responsively directs an increasing flow of heat transfer fluid through the refrigerated heat exchanger 17.

Figure 3:
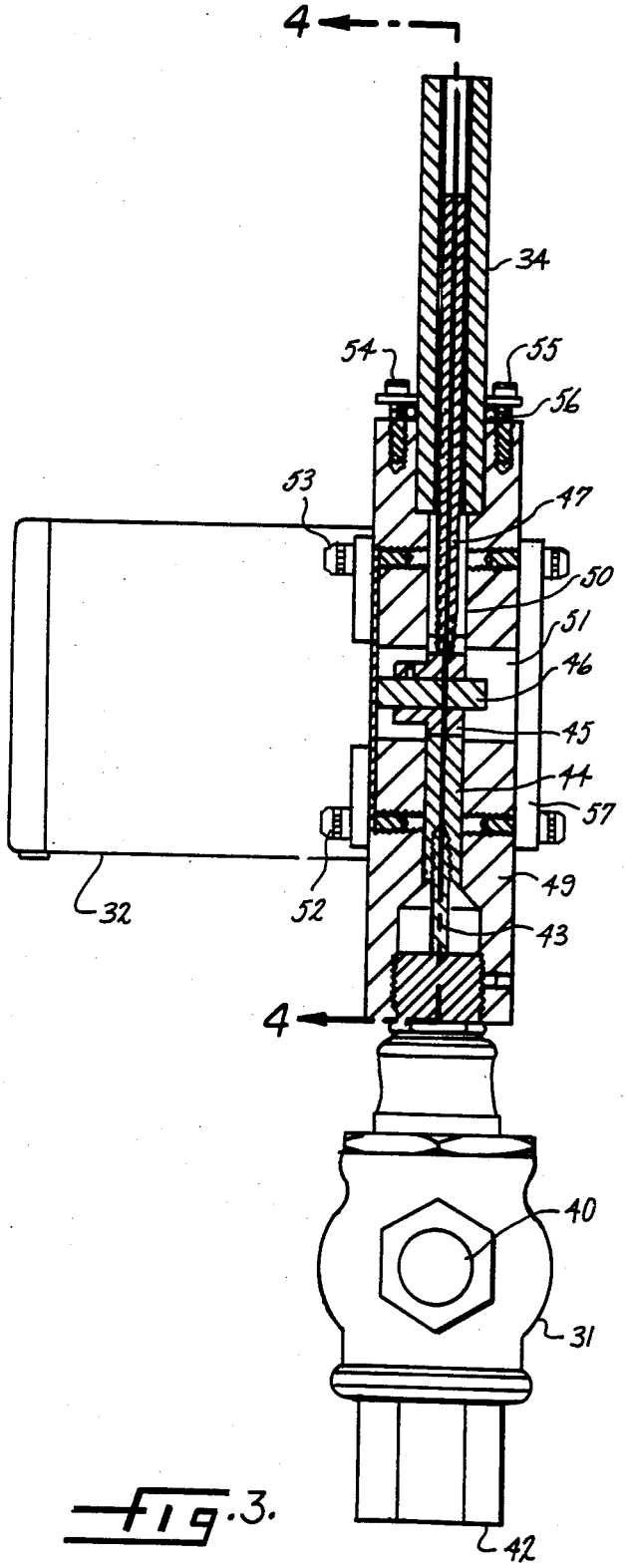
FIG. 3 is a front view, in partial section, of the mixing valve and servo control used in the preferred embodiment of the present invention.
Figure 4:
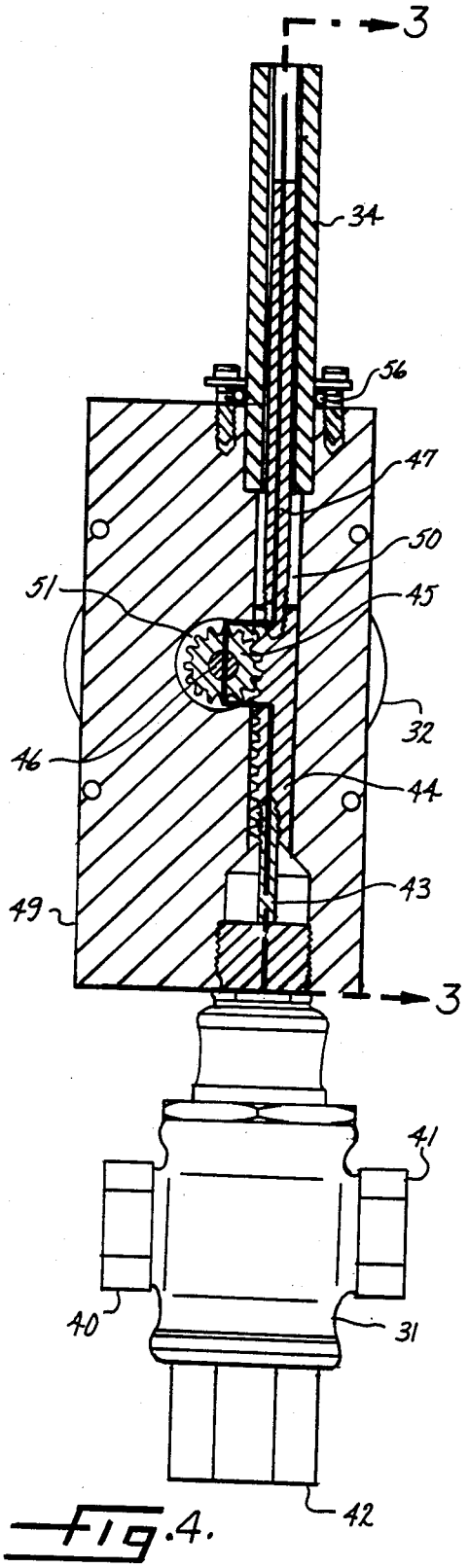
FIG. 4 is a side view, in partial section, of the mixing valve and servo control shown in FIG. 3.

One of the principal advantages of using the mixing valve 31 to selectively bypass the circulation of fluid through the heat exchanger 17 is that the mixing valve 31 can be adjusted very rapidly in response to the cooling control signal. Turning now to FIGS. 3 and 4 there are shown front and side views, respectively, of the mixing valve and the servomotor. By using the arrangement shown in FIGS. 3 and 4, the mixing valve can be adjusted to change the relative circulation of fluid through the heat exchanger 17 from 0% to 100% in approximately 3 seconds. The mixing valve 31 is a part number V5013B three-way mixing valve sold by Honeywell Industrial Control Division, Ft. Washington, Pa. 19034. The motor 32 is a model MO92-FD08 stepping motor manufactured by Superior Electric Co., Bristol, Conn. 06010. The stepping motor is rated at 3 volts 4 amps DC per coil providing 200 inch-ounces of torque. The stepping motor is constructed to provide 400 half steps per revolution. The stepping motor provided more precise control of the valve 31 than a comparable DC servo motor. The adjustment sensor 34 is a linear voltage displacement transducer (LVDT) Model E500 sold by Schaevitz Engineering, Pennsauken, N.J. 08110.

The mixing valve has an input port 40 and two output ports 41 and 42. To adjust the relative proportions of effluent emitted from the output ports 41 and 42, the mixing valve 31 has a cylindrical valve stem 43 that is axially translated. To permit the stepping motor 32 to axially translate the valve stem 43, the valve stem 43 is screwed into a rack 44 driven by a pinion 45 journaled to the shaft 46 of the stepping motor 32. To detect the precise axial adjustment of the valve stem 43, the rack 44 also threading engages the armature 47 of the linear voltage displacement transducer 34.

Structural support for the stepper motor 32 and the linear voltage displacement transducer 34 is provided by a gear housing 49 consisting of a block of material such as aluminum having perpendicular bores 50, 51 for receiving the rack 44 and the pinion 45, respectively. The bore 50 is counterbored at each end to receive the mixing valve 31 and the linear voltage displayment transducer 34. The stepper motor 32 is mounted to the housing 49 via machine screws 52 and 53. Also, machine screws 54, 55 secure the linear voltage displacement transducer 34 to the housing 49. The bores 50 and 51 are further sealed by an O ring 56 and an access plate 57, respectively.

Figure 5:
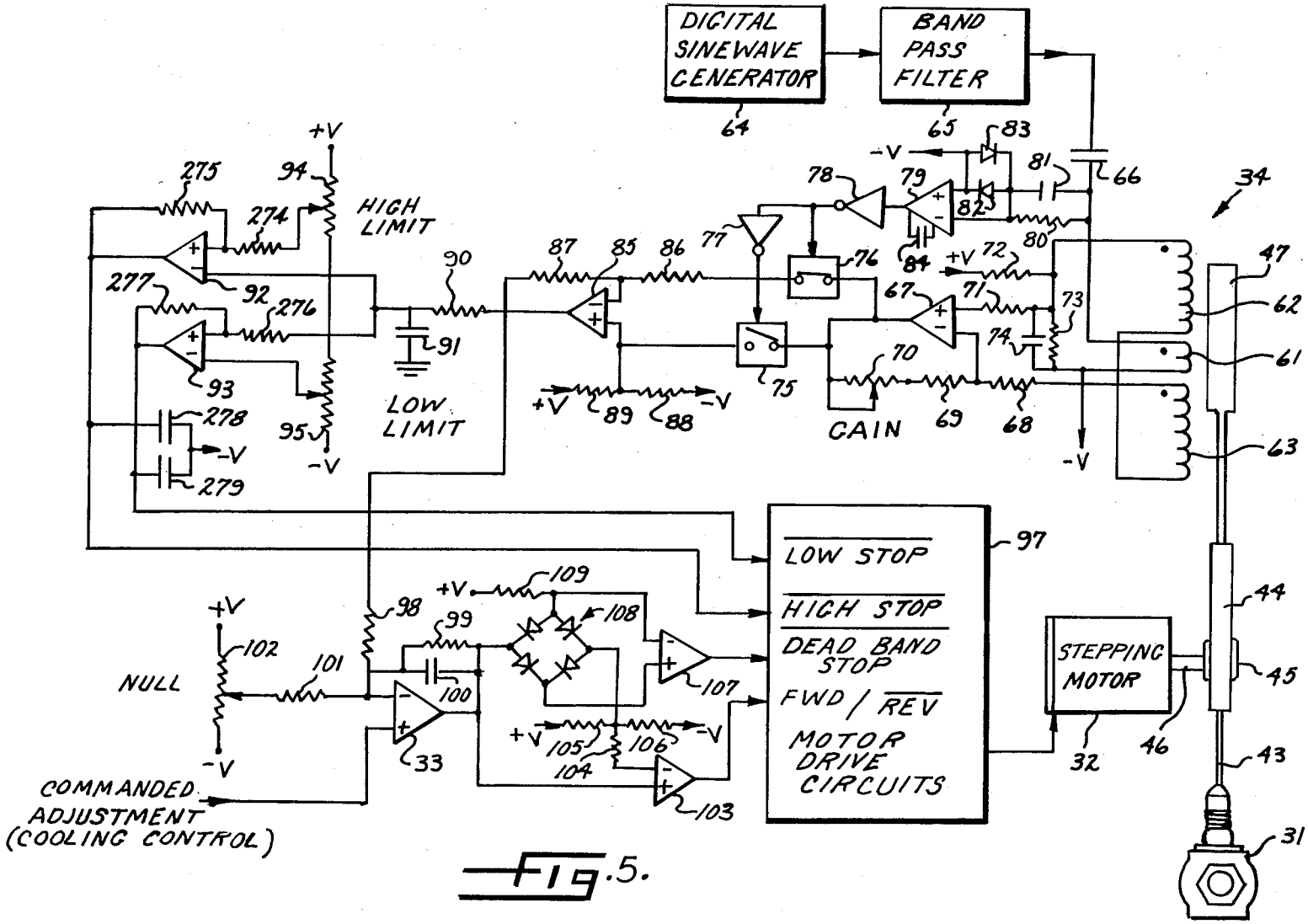
FIG. 5 is a schematic diagram of the servo control loop for adjusting the mixing valve to a commanded position to obtain a desired level of cooling.

Turning now to FIG. 5 there is shown the servo control loop for the mixing valve 31. The linear voltage displacement transducer generally designated 34 is a kind of differential transformer having a primary winding 61 and two secondary windings 62, 63 that are connected in series but with opposite polarity. Thus, the net signal from the secondary winding 62, 63 has an amplitude and phase responsive to the displacement of the armature 47 from a central null position. To excite the primary winding 61, a digital sine wave generator 64 generates a 2.5 kilohertz piece wize linear approximation to a sine wave which is filtered by a 2.5 kilohertz band pass filter 65, to obtain a clean sine wave applied to the primary winding through a series capacitor 66. The capacitor 66 is, for example, 0.22 mfd. The net signal from the secondary windings 62, 63 is amplified by an operational amplifier 67, typically part number LM207. The gain of the amplifier 67 is adjustable within a range about 1.5 to 3.5 and is set by a series input resistor 68, typically 51.1K ohms, and a feed back resistance comprising a resistor 69 typically 75K ohms in series with a variable resistor 70 typically 100K ohms. The operational amplifier 67 is biased by a series resistor 71 typically 51.1K ohms, and a voltage divider comprising resistors 72 and 73, which are each typically 10K ohms. A capacitor 74, typically 0.22 mfd, provides an AC shunt to the minus supply voltage −V. It should be noted that the total supply voltage (+V, −V) for the servo loop is twelve volts.

A DC position indicating signal is obtained from the 2.5 kilohertz signal from the amplifier 67 by sychronous demodulation. The demodulator is comprised of two analog switches 75, 76, typically part number 4066, which are alternately opened and closed at the 2.5 kilohertz frequency. Control for the analog switches 75, 76 is provided by inverters 77 and 78. An operational amplifier 79 drives the inverter 78 which controls the analog switch 76 and in turn drives the inverter 77 which controls the analog switch 75. The operational amplifier 79, typically part number CA 3130, has its positive input tied to minus supply −V, and has its negative input connected to the capacitor 66 and primary winding 61 through a resistor 80 and capacitor 81, typically 80.6K ohms and 0.01 mfd, respectively. To aid limiting action, the negative and positive inputs of the operational amplifier 79 are shunted by a pair of opposite polarity diodes 82 and 83, typically part number 1N4148. The operational amplifier 79 uses a compensation capacitor 84 typically 220 pf.

So that the sychronous demodulator has a balanced output, the outputs signals from the analog switches 75, 76 are fed to a plus and minus unity gain combiner amplifier 85, part number LM207. The series input resistor 86, the feed back resistor 87, and the biasing resistors 88 and 89 are all typically 100 K ohms. The output of the combiner amplifier 85 has a DC component which indicates the adjustment of the mixing valve 31.

In order to define high and low limits or stop positions for the mixing valve adjustment, the position signal from the amplifier 85 is compared to high and low threshold limits. To obtain the DC component, the output of the amplifier 85 is filtered by a low pass filter comprising a series input resistor 90 and a shunt capacitor 91, typically 20K ohms and 0.1 mfd respectively. The signal from the capacitor 91 is fed to respective high and low threshold detectors comprising operational amplifiers 92 and 93, respectively, part numbers LM311. The high and low limits are set by potentiometers 94 and 95, respectively. The outputs of the operational amplifiers 92, 93 are fed to motor drive circuits 97 which energize the stepping motor 32 and prevent the motor from traveling past the limit stop positions.

The comparator 33 previously shown in FIG. 2 compares the command adjustment to the sensed adjustment indicated by the operational amplifier 85. The operational amplifier 33, typically part number LM207, has a series input resistor 98, typially 10K ohms, and a feed back resistor 99 and feed back capacitor 100, typically 510K ohms and 0.0068 mfd, respectively. To provide a null adjustment for the servo loop, the negative input of the operational amplifier 33 is fed through a series resistor 101 to a null adjusting potentiometer 102. Typically the series resistor 101 is 100K ohms, and the potentiometer 102 is also 100K ohms.

The stepping motor 32 is driven forward or reverse depending on the polarity of the error signal from the operational amplifier 33, so long as the error is substantial. An operational amplifier 103, typically part number LM207, functions as a limiter biased between plus and minus supply (+V, −V) by a series resistor 104, typically 51K ohms, and voltage dividing resistors 105 and 106, both typically 10K ohms. So that the stepping motor 32 is not activated unless the error signal is substantial, the motor drive circuits 97 are inhibited by a dead band detector comprising an operational amplifier 107 and a diode bridge rectifier 108. The operational amplifier 107 is typically part number LM207, and the diodes in the bridge 108 are part number 1N4148. A biasing resistor 109 from plus supply +V, typically 22M ohms, biases the operational amplifier 107 to a logical low state, unless the error output of the operational amplifier 33 exceeds 2 diode drops above the reference voltage between plus and minus supply (+V, −V). It should be noted that since the stepping motor 32 is inhibited by the dead band sensed by the operational amplifier 107, which is in turn responsive to the difference between the cooling control signal or commanded adjustment and the sensed adjustment of the mixing valve, short cycling and oscillation or hunting of the servo control loop in FIG. 5 is prevented.

Figure 6:
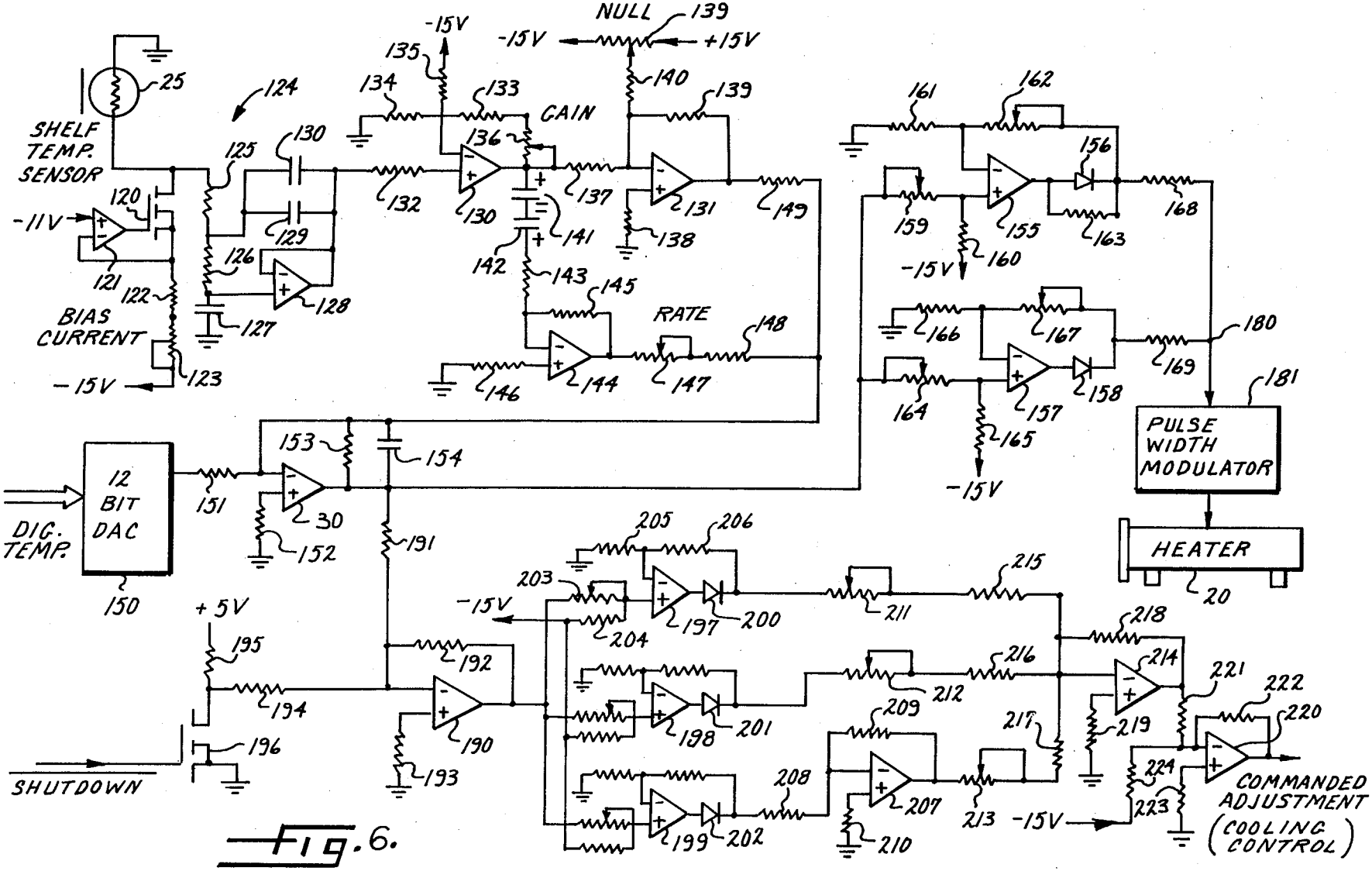
FIG. 6 is a schematic diagram of the heating and cooling control loop including a shelf temperature sensor, a rate function generator, and nonlinear gain characterization for both heating and cooling.

Turning now to FIG. 6 there is shown the "outer" portion of the temperature control loop for both heating and cooling. The means 25 for sensing the temperature of the heat applied to the product in the drying chamber 12 is a temperature dependent resistance providing a change of two ohms per °C., and is approximately 486 ohms at 0.0° C. A bias current is supplied to the temperature dependent resistance 25 by a field effect transistor 120 regulted by an operational amplifier 121 in combination with current sensing resistors 122 and 123. The field effect transistor 120 is typically part number VN10KM, the operational amplifier 121 is part number 714, and the resistors 122 and 123 are 2K ohms and 1K ohms, respectively. The adjustable resistors 123 is adjusted to give a bias current of three milliamperes resulting in a six millivolt per degree Celsius temperature indicating voltage. This temperature indicating voltage is passed through a five hertz active filter generally designated 124 comprising series resistors 125, 126 typically 100K ohms, a shunting capacitance 127 typically 0.22 mfd, a voltage follower operational amplifier 128, part number LM207, and feed back capacitors 129 and 130, both typically 0.22 mfd. Gain for the shelf temperature sensor 25 is provided by operational amplifiers 130 and 131, typically part number 714 and LF357, respectively. The operational amplifier 130 has an input resistor 132, typically 40.2K ohms, a feed back resistor 133 typically 243K ohms, and biasing resistors 134 and 135, typically 40.2K ohms and 343K ohms respectively. A variable feed back resistor 136, typically 20K ohms, sets the amplifier gain. The operational amplifier 131 has a series input resistor 137, typically 20K ohms, a biasing resistor 138, typicaly 15K ohms, and a feed back resistor 139, typically 40.2K ohms. The negative input of the operational amplifier 131 is connected to a null adjusting potentiometer 139, typically 100K ohms, through a resistor 140, typically 100K ohms. It should be noted that the operational amplifiers use plus and minus 15 volt supplies with respect to signal ground, which is at −V with respect to the "inner" servo control circuits of FIG. 5.

To provide a rate function for the temperature control loop and thereby reduce temperature overshoot during the operation of the freeze dryer 10 in a production run, the temperature indicating signal on the output of the operational amplifier 130 is differentiated by an RC network comprising capacitors 141 and 142 and a series input resistor 143 to an operational amplifier 144. The capacitors 141 and 142 are typically 200 mfd electrolitic capacitors connected in series with opposite polarity. The series resistor 143 is typically 10K ohms. The operational amplifier 144 has a feed back resistor 145 typically 200K ohms, and a biasing resistor 146 typically 200K ohms. The rate function amplifier 144 is typically part number LF357. To adjust the rate of the temperature control loop, an adjustable resistor 147, typically 1M ohms, provides a wide variation in the available rate. The rate function is summed with the proportional temperature signal from the operational amplifier 131 through summing resistors 148 and 149, both typically 20K ohms, and the sum signal is applied to the comparator 30 which compares the temperature sensed by the shelf temperature sensor 25 to the desired temperature from the microcomputer 21 in FIG. 2. The microcomputer 21 in FIG. 2 includes a 12 bit digital to analog converter 150, typically part number DAC 1201MDC, which generates 100 millivolts per degree Celsius of desired temperature provided by the microcomputer 21. The desired temperature is fed to the comparator 30 via a series resistor 151, typically 20K ohms. The comparator 30, typically part number LF357, has a biasing resistor 152, typically 5.1K ohms, a feed back resistor 153, typically 20K ohms, and a feed back capacitor 154, typically 1.0 mfd.

The diode 36 shown in FIG. 2 is a highly schematic representation for the nonlinear gain function controlling the heater 20. This heating nonlinear gain function is built up of a sumation of two piece wize linear segments, each piece wize linear segment being generated by an operational amplifier and a diode. The first segment is generated by an operational amplifer 155 and a diode 156, and the second is generated by an operational amplifier 157 and a diode 158. The operational amplifiers are typically part number 714 and the diodes are typically 1N4148. The first operational amplifier 155 has an adjustable series input resistor 159, typically 500 ohms, a positive bias resistor 160 typically 75K ohms, a negative bias resistor 161 typically 1.5K ohms, and an adjustable feed back resistor 162 typically 100K ohms. The diode 156 is shunted by a high valued resistor 163, typically 22M ohms, which is operative when the diode 156 is nonconductive. The second gain characterization amplifier 157 has an adjustable series input resistor 164, typically 5K ohms, a positive biasing resistor 165 typically 75K ohms, a negative biasing resistor 166 typically 1.5K ohms, and an adjustment feed back resistor 167 typically 100K ohms. The output of the diodes 156, 158 are summed together by respective summing resistors 168, 169, both typically 20K ohms. The output signal on the summing node 180 is the heating control signal which proportionally activates the heater 20. This is done by applying the heater control signal to a conventional pulse width modulator 181 which generates a digital signal exciting the heater at a high frequency but having a duty cycle responsive to the value of the heating control signal.

While the heating control signal is active when the output of the comparator 30 is positive, the cooling control signal is active when the output of the comparator 30 is negative. In order to use gain characterization circuits similar to those used for heating control, the cooling control signal is inverted by an amplifier 190 including a series input resistor 191 typically 20K ohms, a feed back resistor 192 typically 20K ohms, a positive biasing resistor 193 typically 20K ohms, and negative biasing resistors 194 and 195, both typically 10K ohms, leading to a +5 V supply simulating a desired heating signal. A field effect transistor 196 shunts resistors 194 and 195 to ground when a shut down signal is inactive. The microcomputer 21 (FIG. 2) may shut off both heating and cooling by setting the digital temperature to a minimum temperature thereby shutting off the heater and also by setting the shut down signal active low to the field effect transistor 196 thereby shutting off cooling by enabling the simulated desired heating signal.

The gain characterization circuits for cooling include three operational amplifiers 197, 198, and 199 working in conjunction with respective diodes 200, 201, and 202. The operational amplifier 197 and diode 201 are active for low cooling errors, the second operational amplifier 198 and diode 201 are active to increase the loop gain for high cooling errors, and the third operational amplifier 199 and diode 202 are active at even higher cooling errors but operate to reduce the loop gain at high error levels. The first amplifier 197 has a series input variable resistor 203 typically 5K ohms, a positive biasing resistor 204 typically 75K ohms, a negative biasing resistor 205 typically 20K ohms, and a feed back resistor 206 typically 20K ohms. The amplifier 197 is typically part number 741, and the diode 200 is typically part number 1N4148. The amplifiers 198, 199 and diodes 201, 202 are similar and have similar series input, biasing, and feed back resistors. The third amplifier 199 works in conjunction with an inverting amplifier 207 having a series input resistor 208 typically 2.0K ohms, a feedback resistor 209 typically 20K ohms, and a positive biasing resistor 210 typically 10K ohms.

The relative gains provided by the three amplifiers 197, 198, 199 are adjusted by variable resistors 211, 212, and 213, respectively, all typically 1M ohms. The adjusted signals are fed to a summing amplifier 214 comprising summing input resistors 215, 216, and 217 all typically 10K ohms. The summing amplifier 214 has a feedback resistor 218 typically 200K ohms, and a biasing resistor 219 typically 3K ohms. A final amplifier 220 generates the commanded adjustment or cooling control signal fed to the comparator 33 of FIG. 5. This final amplifier 220 has a series input resistor 221 typically 20K ohms, a feedback resistor 222 typically 20K ohms, a positive biasing resistor 223 typically 10K ohms, and a negative biasing reister 224 typically 100K ohms.

Figure 7:
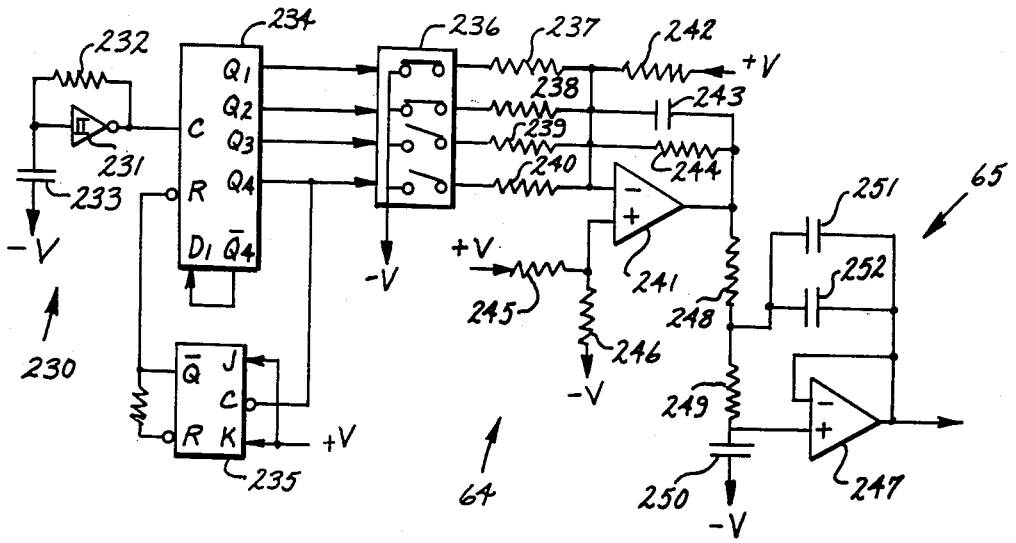
FIG. 7 is a schematic diagram of a preferred digital sine wave generator used in the servo control loop of FIG. 5.

Turning now to FIG. 7 there are shown the preferred circuits for the digital sine wave generator generally designated 64 and the band pass filter generally designated 65 that were used in the inner servo control loop of FIG. 5. The 2.5 kilohertz sine wave for exciting the linear voltage displacement transducer 34 is derived from a 20 kilohertz square wave generated by a Schmitt trigger oscillator generally designated 230 comprising a Schmitt trigger 231 typically part number 74C14, a feedback resistor 232 typically 39.2 K ohms, and an input capacitor 233 typically 0.001 mfd, shunted to ground. The 20 kilohertz square wave is divided down to an eight phase 2.5 kilohertz square wave by a four stage serial shift register 234 configured as a Johnson counter with the complement of the last stage output $Q_4$ fed back to the input $D_1$ of the first stage. A J/K flip-flop 235 is used to reset the Johnson counter to the proper initial state. The J/K flip-flop 235 is configured as a toggle flip-flop with the J and K inputs tied to logic high or +V. A high to low transition on the $Q_4$ output of the shift register 234 toggles the flip-flop 235 causing the Q complement output to temporarily go low, resetting both the flip-flop 235 and the shift register 234. The shift register 234 is typically part number 74C175 and the flip-flop 235 is typically part number 74C107.

The parallel outputs of the shift register 234 activate respective analog switches 236, typically part number 4066. These analog switches shunt respective resistors 237, 238, 239, 240 to ground. The values of the resistors 237–240 are weighted so that a piece wise linear approximation to a sine wave is generated. Respective values for the resistors are, for example, 365K ohms for resistors 237 and 240, and 191K ohms for resistors 238 and 239. The resistors are series input resistors to an operational amplifier 241 having a negative bias resistor 242 typically 121K ohms, a feedback capacitor 243 typically 470 pf, a feedback resistor 244 typically 100K ohms, and a voltage divider providing a positive bias voltage comprising resistors 245 and 246, which are both typically 100K ohms.

The band pass filter 65 is a two pole active filter including an operational amplifier 247 used as a follower, typically part number LM207. The active filter 65 also includes series resistors 248 and 249, which are both typically 22.1K ohms. The band pass filter also has a shunt capacitor 250 typically 0.001 mfd, and feedback capacitors 251 and 252 which are both typically 0.001 mfd.

Figure 8:
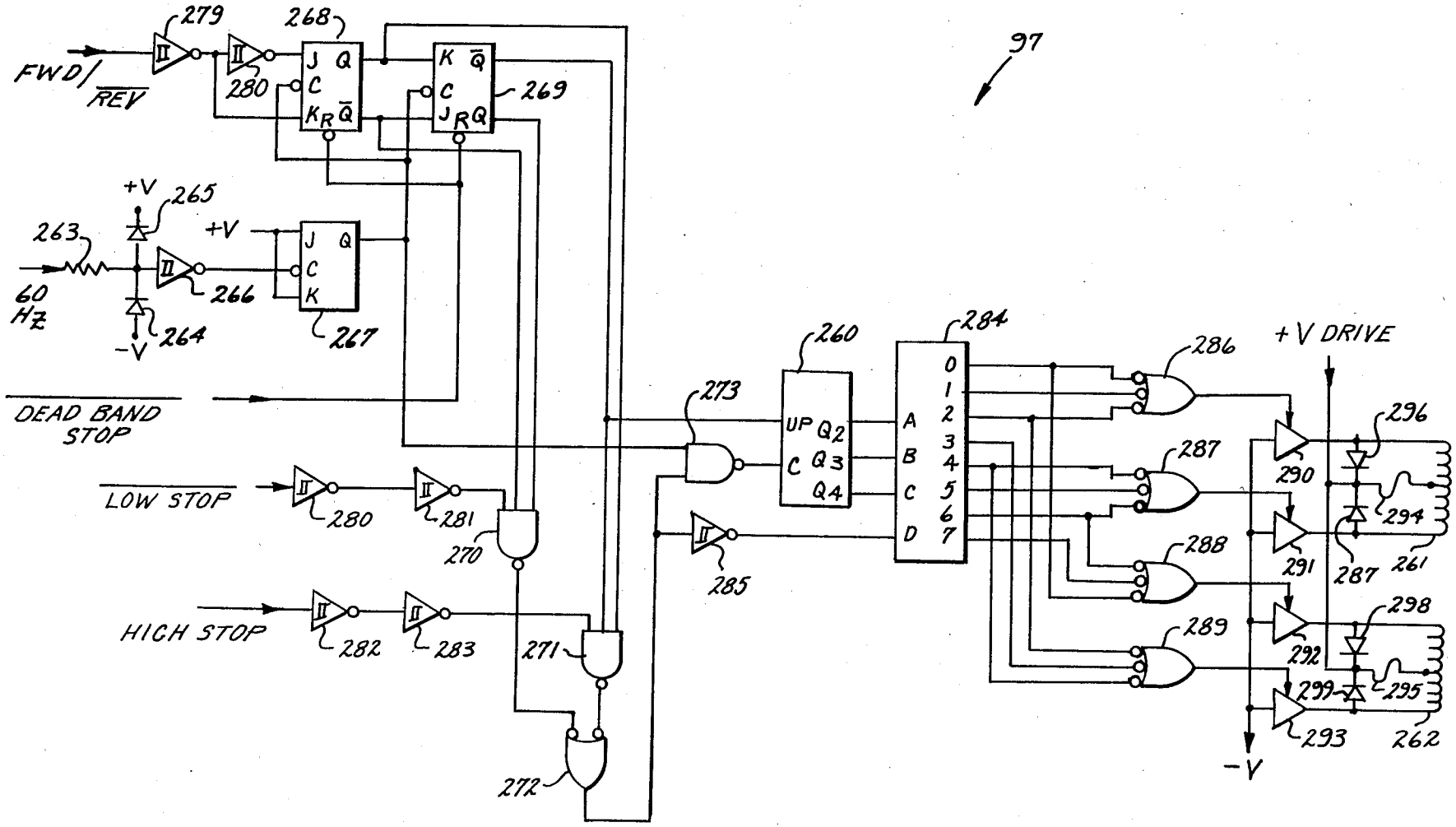
FIG. 8 is a schematic diagram of the preferred motor drive circuits used in the servo control loop of FIG. 5.

A detailed schematic of the motor control circuits 97 used in FIG. 5, is shown in FIG. 8. The heart of a circuit is a synchronous up/down counter 260 which is typically part number 4516. When the counter 260 is counting up, the coils 261 and 262 of the stepper motor 32 are energized in half-step sequence to rotate the motor shaft 46 clockwise. When the counter 260 counts downwardly, the motor coils 261, 262 are energized in half-step sequence for counter clockwise rotation of the motor shaft 46. The synchronous counter 260 is clocked at a 30 hertz rate. To generate the 30 hertz clocking signal, a 60 hertz signal from the secondary of a power supply transformer is fed through a resistor 263, typically 51K ohms, to clipping diodes 264 and 265, typically part number 1N4148, which clamp the 60 hertz signal to within the power supply range. The 60 hertz signal is further limited by a Schmitt trigger inverter 266, typically part number 74C14, and used to clock a J/K flip-flop 267. The J and K inputs of the flip-flop 267 are both tied to positive supply so that the flip-flop functions as a binary divider to generate the 30 hertz clocking signal.

To synchronize the forward/reverse signal for selecting either the counting up or counting down of the counter 260, a pair of J/K flip-flops 268, 269 receive the forward/reverse signal after the forward/reverse signal has been cleaned up by a pair of Schmitt inverters 279 and 280. In order to inhibit the clocking of the counter 260 when the DEAD BAND STOP signal is active low, the DEAD BAND STOP signal is applied to the reset inputs of the flip-flops 268, 269. The outputs of the flip-flops 268, 269 are combinded in two triple input NAND gates 270, 271, typcially part number 74C10 and in a two-input NAND gate 272, typically part number 74C00. The output of the gate 272 is applied to a two input NAND gate 273 which inhibits the 30 hertz clock to the counter 260.

The LOW STOP and HIGH STOP signals are not synchronized to the 30 hertz clocking signal. Instead, analog components in FIG. 5 insure that there are no glitches in these signals. These analog components include hysteresis inducing resistors 274, 275, 276, 277, and filter capacitors 278 and 279. The series resistors 274 and 276 are typically 1K ohms and the positive feedback resistors 275 and 277 are typically 1M ohms. The capacitors 278 and 279 are typically 0.1 mfd. The capacitors 278 and 279 cooperate with pairs of Schmitt inverters 280, 281, 282, and 283 shown in FIG. 8.

The up/down counter 260 is used in conjunction with a decoder 284 which generates an eight phase clock at 3.75 hertz. The decoder 284 is a BCD decoder, tyically part number 74C42, having a "D" input that is used in this case as an inhibit input, active high, that receives the complement of the clock enable signal from the output of the NAND gate 272. The complement function is provided by a Schmitt inverter 285.

In order to drive the two balanced windings 261, 262 of the stepper motor, four phases of the 3.75 hertz clock are needed. Each of these four phases is obtained from a respective set of three consecutive outputs of the decoder 284, which are combined by respective triple-input NAND gates 286, 287, 288, and 289. The center terminals of the stepping motor windings 261, 262 are connected to a positive drive voltage which is 24 VDC above the minus supply voltage (−V). The outputs of the NAND gates 286, 287, 288, 289 activate respective current sinks 290, 291, 292, and 293. To provide short circuit protection, two five-amp fuses 294, 295 connect the respective center terminals of the stepping motor windings 261, 262 to the positive drive voltage supply. Transient current surges from the windings 261, 262 are eliminated by damper diodes 296, 297, 298, and 299. The diodes are typically part number 1N5624.

Figure 9:
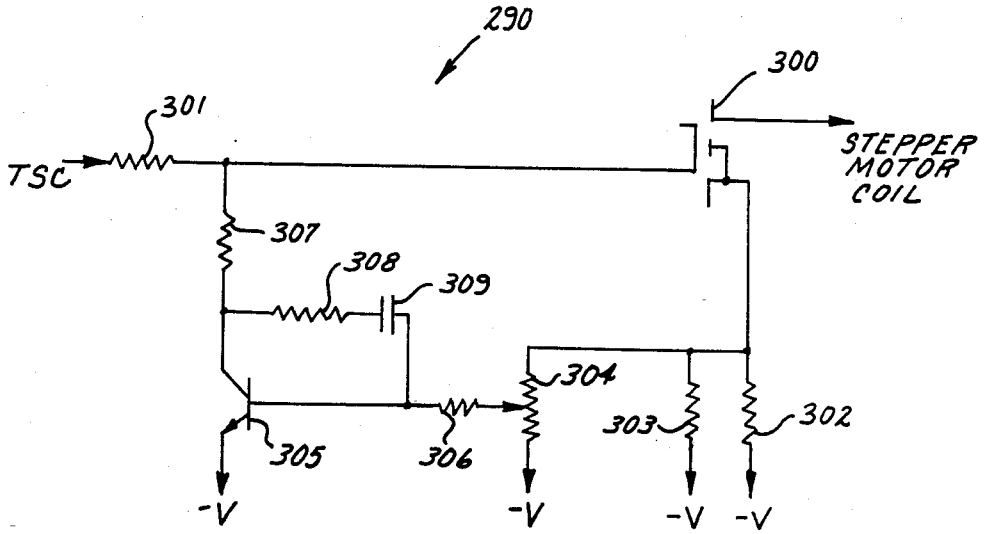
FIG. 9 is a schematic diagram of one of the drivers used in the motor drive circuit of FIG. 8 to excite the motor windings.

Turning now to FIG. 9 there is shown in greater detail a schematic diagram of one of the current sinks 290, 291, 292, and 293. The power component of the current sink 290 is a power FET 300 such as part number IRF133. The gate of the FET receives the tristate control signal (TSC) through a series resistor 301 typically 20K ohms. In order to provide a current limiting function, the drain of the FET 300 is connected to the minus supply (−V) through current sensing resistors 302 and 303, which are typically 0.470 ohm 5 watt resistors. A protentiometer 304, typically 100 ohms, provides a current sensing voltage. This current sensing voltage is applied to an NPN bipolar transistor 305 through a series resistor 306, typically 51 ohms. When the transister 305 is driven into conduction, the tristate control voltage (TSC) applied to the gate of the FET 300 is reduced through a current sinking resistor 307, typically 100 ohms. The stability of the current sink 290 is insured by a resistor 308, typically 750 ohms, and a capacitor 309, typically 0.001 mfd, connecting the base to the collector of the transistor 295. The potentiometer 304 is adjusted to limit the maximum level of current sinking by the FET 300 to 3.5 amperes. It should be noted that the tristate control signals (TSC) applied to the drivers 280 and 281, as well as 282 and 283, are nonoverlapping. Hence, it is economical to share the current sensing resistors 292, 293 and 294, between these pairs of current sinks.

In view of the above, an improved temperature control system for a freeze dryer has been described that more precisely regulates the temperature in the shelf assembly of a freeze dryer by using a servo-controlled mixing valve which selectively bypasses the refrigerated heat exchanger. Instead of cycling the refrigeration unit on and off, the refrigeration unit operates continuously for high reliability and uniformity of the heat exchanger temperature. By using a stepping motor, the mixing valve is rapidly and precisely adjusted in response to the cooling control signal active when the temperature in the drying chamber exceeds the desired temperture. To prevent short cycling and oscillation in the temperature control loop, the stepping motor is responsive to a rate function, a nonlinear gain characteristic, and a dead band generator.

What is claimed is:

1. A temperature control system for a freeze dryer of the type having a drying chamber and shelf assembly for receiving the product to be dried, a vacuum pump for evacuating the drying chamber, a low temperature condenser for condensing water vapor from the drying chamber, and a heat transfer system for regulating the temperature of the shelf assembly including a heater for applying heat to a heat transfer fluid, a refrigerator and low temperature heat exchanger for removing heat from the heat transfer fluid, and a circulation pump for providing circulation of the heat transfer fluid past the heater, low temperature heat exchanger and the shelf assembly, said temperature control system having means for providing a desired temperature of the shelf assembly as a predetermined function of time defining a freeze drying cycle, at least one temperature sensor sensing the temperature of the heat being applied to the product in the drying chamber, and means for selectively energizing said heater when said desired temperature is greater than the second temperature, wherein the improvement comprises means for regulating said circulation of said heat transfer fluid past said low temperature heat exchanger in response to a cooling control signal, and means for generating said cooling control signal when said desired temperature is less than said sensed temperature, so that the circulation of said heat transfer fluid past said low temperature heat exchanger is increased in response to an increasing difference between said sensed temperature and said desired temperature, wherein said means for regulating said circulation of said fluid past said low temperature heat exchanger comprises a mixing valve selectively bypassing the circulation of said fluid past the low temperature heat exchanger and a servomotor adjusting said mixing valve in response to said cooling control signal, and wherein said means for generating a cooling control signal includes means for generating a rate function and means for generating a nonlinear gain characteristic, and said means for selectively energizing said heater is responsive to said means for generating a rate function.

2. A temperature control system for a freeze dryer of the type having a drying chamber for receiving the product to be dried, a vacuum pump for evacuating the drying chamber, a low temperature condenser for condensing water vapor from the drying chamber, a heater for applying heat to the product to be dried, a low temperature heat exchanger for cooling the product to be dried, and a circulation pump for circulating heat transfer fluid to distribute heat among the heater, low temperature heat exchanger, and product to be dried, said temperature control system comprising, in combination, a computer providing a desired temperature of the heat to be applied to the product in the drying chamber as a predetermined function of time defining a freeze drying cycle, at least one temperature sensor sensing the temperature of the heat being applied to the product in the drying chamber, means for comparing the desired temperature to the sensed temperature to generate a temperature error signal, means for generating a signal to energize said heater in response to said temperature error signal when said desired temperature is greater than the sensed temperature, means for generating a cooling control signal in response to the temperature error signal when the desired temperature is less than the sensed temperature in the drying chamber, and means for increasing the circulation of said heat transfer fluid through said below temperature heat exchanger in response to the cooling control signal, wherein the means for generating the cooling control signal in response to the temperature error signal includes means for generting a rate function and means for generating a nonlinear gain characteristic.

3. A temperature control system for a freeze dryer of the type having a drying chamber for receiving the product to be dried, a vacuum pump for evacuating the drying chamber, a low temperature condenser for condensing water vapor from the drying chamber, a heater for applying heat to the product to be dried, a low temperature heat exchanger for cooling the product to be dried, and a circulation pump for circulating heat transfer fluid through the heater, the low temperature heat exchanger, and the drying chamber, said temperature control system having means for providing a desired temperature of the heat to be applied to the product in the drying chamber as a predetermined function of time defining a freeze drying cycle, at least one temperature sensor sensing the temperature of the heat being applied to the product in the drying chamber, and means for selectively energizing said heater when said desired temperature is greater than the sensed temperature, wherein the improvement comprises, a mixing valve for selectively bypassing said circulation of said heat transfer fluid through said low temperature heat exchanger, means for adjusting the mixing valve including a servomotor, means for sensing the adjustment of the mixing valve, and means for comparing the sensed adjustment to a cooling control signal to generate a signal for activating the servomotor, and means for generating said cooling control signal when said desired temperature is less than the sensed temperature, so that the circulation of said heat transfer fluid through the low temperature heat exchanger is increased in response to an increasing difference between said sensed temperature and said desired temperature, wherein said means for generating said cooling control signal includes means for generating a rate function and means for generating a nonlinear gain characteristic, so that a fast response time is obtained without substantial temperature overshoot.

4. The temperature control system as claimed in claim 3, wherein said means for selectively energizing said heater is responsive to said rate function.

* * * * *